US005901504A

United States Patent [19]

Stoll et al.

[11] Patent Number: 5,901,504

[45] Date of Patent: May 11, 1999

[54] ROOF OF A STRUCTURE

[75] Inventors: Wilfried Stoll, Stuttgart; Axel Thallemer, Esslingen, both of Germany

[73] Assignee: Festo KG, Esslingen, Germany

[21] Appl. No.: 08/809,359

[22] PCT Filed: Jun. 13, 1996

[86] PCT No.: PCT/EP96/02558

§ 371 Date: Mar. 10, 1997

§ 102(e) Date: Mar. 10, 1997

[87] PCT Pub. No.: WO97/03265

PCT Pub. Date: Jan. 30, 1991

[30] Foreign Application Priority Data

Jul. 12, 1995 [DE] Germany ..... 195 25 374

[51] Int. Cl.[6] ..... E04H 15/20

[52] U.S. Cl. ..... 52/2.22; 52/2.23; 52/6; 52/22

[58] Field of Search ..... 52/2.18, 2.22, 52/2.23, 6, 22, 262

[56] References Cited

U.S. PATENT DOCUMENTS

| | | | |
|---|---|---|---|
| 2,946,337 | 7/1960 | Wolshin | 135/115 X |
| 4,146,996 | 4/1979 | Arnesen . | |
| 5,079,887 | 1/1992 | Anderson | 52/22 X |

FOREIGN PATENT DOCUMENTS

| | | | |
|---|---|---|---|
| 03 45 600 A1 | 12/1989 | European Pat. Off. . | |
| 04 94 053 A1 | 7/1992 | European Pat. Off. . | |
| 955651 | 1/1950 | France | 52/2.23 |
| 15 57 401 | 9/1969 | Germany . | |
| 0S 19 13 577 | 10/1970 | Germany . | |
| 31 27 005 A1 | 1/1983 | Germany . | |
| 86 24 577 U1 | 5/1990 | Germany . | |
| 43 43 303 A1 | 8/1994 | Germany . | |
| 710121 | 6/1966 | Italy | 52/2.23 |
| WO 94/13909 | 6/1994 | WIPO . | |

OTHER PUBLICATIONS

German Bauzeitschrift–DBZ, NR. 7, Jul. 1992, pp. 1283–1299, XP002013671, G. Minke. "Pneumatisch stabilisierte Membrantragweirk.".

German zeitserift (Bauen+Wohnen), Nov., 1971, pp. 501–508.

*Primary Examiner*—Christopher Kent
*Assistant Examiner*—Timothy B. Kang
*Attorney, Agent, or Firm*—Hoffman & Baron, LLP

[57] ABSTRACT

A roof for a built structure is proposed, which is designed in the form of a hollow body structure. It possesses interconnected walls (18 and 19) of flexible and at least substantially air-impermeable material. These walls (18 and 19) constitute elongated chambers (22), which are arranged side by side in sequence and are alternatingly designed as vacuum chambers (24) and gage pressure chambers (23). It is in this manner that an extremely strong, free span roof is created.

17 Claims, 4 Drawing Sheets

ROOF OF A STRUCTURE

The invention relates to a roof of a built structure and more particularly of a building-like structure such as a hall or a shed, a trade fair stand and an open-sided shelter or the like.

Known roofs of this type are composed of a trussed roof structure and a roof sheet borne thereby which is generally made up of plate-like elements.

In the case of a built structure described in the German utility model G 9,418,076.8 a roof of the type initially mentioned is present, which is composed of individual sheet-like roof elements individually carried on supports. In order to facilitate handling the roof elements are constituted by air-tight hollow bodies inflated with compressed air. The large number of supports required does however reduce the utility of the area covered by the roof.

One object of the present invention is to provide a roof of the type initially mentioned, which while being easy to erect provides a free span roof for large areas.

In order to achieve this aim a hollow body structure with linked walls of flexible and at least substantially air-impermeable material is provided, the walls delimiting, in a row direction, elongated chambers arranged in sequence side by side, such chambers being in the form of alternating gage pressure chambers subject to a gage pressure and vacuum chambers subject to vacuum.

A roof erected in this manner renders possible the realization of large free span configurations. Consequently large areas may be covered over without having to rely on intermediate supports. The design using flexible material facilitates simple shipping to the assembly site and renders possible simple handling during assembly. Owing to the alternating subjection to gage pressure and vacuum (the terms gage pressure and vacuum being related to atmospheric pressure) of the chambers directly placed together in sequence the result is an extremely stiff and dimensionally stable roof design with a relatively low weight. The support action as such is in this case mostly provided by the elements subject a gage pressure which may transfer the forces occurring if required via supports provided at the edges or, respectively, a suitable bearer structure, to the ground. In the vacuum chambers even a low degree of vacuum of the order of 0.005 bar is sufficient to obtain the necessary thrust-related rigidity in the row direction and to prevent flutter of the walls delimiting the vacuum chambers in the wind. It is in this manner that it is possible not only to bridge over large spans but also produce long overall lengths in the row direction. Moreover, even a low vacuum is sufficient to ensure that the vacuum chambers remain in place simply because of their own weight and are not drawn apart. If required it is however possible additionally or as an alternative to provide the support or means for securing the walls of some gage pressure chambers in position as a measure for maintaining the mutual spacing assumed by the gage pressure chambers.

Further advantageous developments of the invention are defined in the dependent claims.

The walls of the gage pressure chambers are preferably so shaped that individual elements are present in the form of hose-like hollow bodies, which respectively delimit one gage pressure chamber. Such hose-like bodies may be manufactured comparatively simply. Their cross sectional configuration is preferably round for reasons of mechanical strength and is more particularly preferably circular.

In order to form a respective vacuum chamber between two adjacent hose-like hollow bodies, in the intermediate space two equally spaced diaphragm elements preferably extend in a direction athwart the direction of the roof, such diaphragm elements constituting, together with the mutually facing wall sections of the hose-like hollow bodies or wall sections in front of the wall sections, the wall of the respective vacuum chambers. Such diaphragm elements can be manufactured as sheet-like elements in a simple fashion. If required they may be attached permanently to the walls of the gage pressure chambers, for example by bonding or welding. However it is preferred to create a releasable joint in order to generally have a modular structure, which as required renders possible the production of roofs with different dimensions and configurations.

The diaphragm elements may themselves also be a component of the hose-like hollow bodies delimiting the vacuum chambers.

The design of the form of the diaphragm elements and/or of the hose-like hollow bodies may for example be used to create a roof in the form of an arrangement with a linear extension in the row direction or with a curved, arcuate form in the row direction. It is in this manner that it is possible for instance to realize roofs with a rectangular or rounded outline, for example also roofs with a circular outline of the roofs, same extending only over part of an angle of 360°. Furthermore it is possible to provide vaulted shapes without any difficulty, more particularly in such a manner that the chambers possess a curved and accordingly laterally outwardly vaulted form in their longitudinal direction.

In order to obtain the desired pressure conditions it is possible for the chambers to be subjected to the desired pressure and for them then to be permanently sealed off. However a design is more advantageous in which the gage pressure chambers are constantly connected with at least one pressure producing means and the vacuum chambers are permanently connected with at least one vacuum producing means so that constant regulation is possible to the desired levels of pressure.

Preferably a design of the structure is employed, in which the gage pressure chambers and the vacuum chambers are connected together more particularly in pairs with a intermediate placement of a pump device to constitute a single system, the pump device drawing in air from the vacuum chamber and simultaneously blowing it into the associated gage pressure chamber. In this case a constant air current to be provided, in the case of which air continuously flows from the surroundings into the vacuum chamber to keep same charged while excess air flows out from the gage pressure chambers into the surroundings. This may be ensured in an extremely simple fashion using suitable inlet and outlet valves, by means of which when required regulation of pressure may be ensured as well. The constant air flow leads to the further effect that there is a removal of humidity and precipitation of condensate is prevented in the chambers.

The roof may be employed in a particularly simple manner in conjunction with a bearer structure as disclosed in the said German utility model G 9,418,076.8. Owing to the support provided therein and filled with compressed air the bearer structure and also the roof itself possess a certain degree of elasticity, this leading to a satisfactory degree of mechanical compatibility.

In what follows the invention will be described with reference to the accompanying drawings in detail.

FIGS. 1 through 5 show a built structure generally referenced 1, in the form of a building-like structure, which is designed as an exhibition shed.

Figure 1:
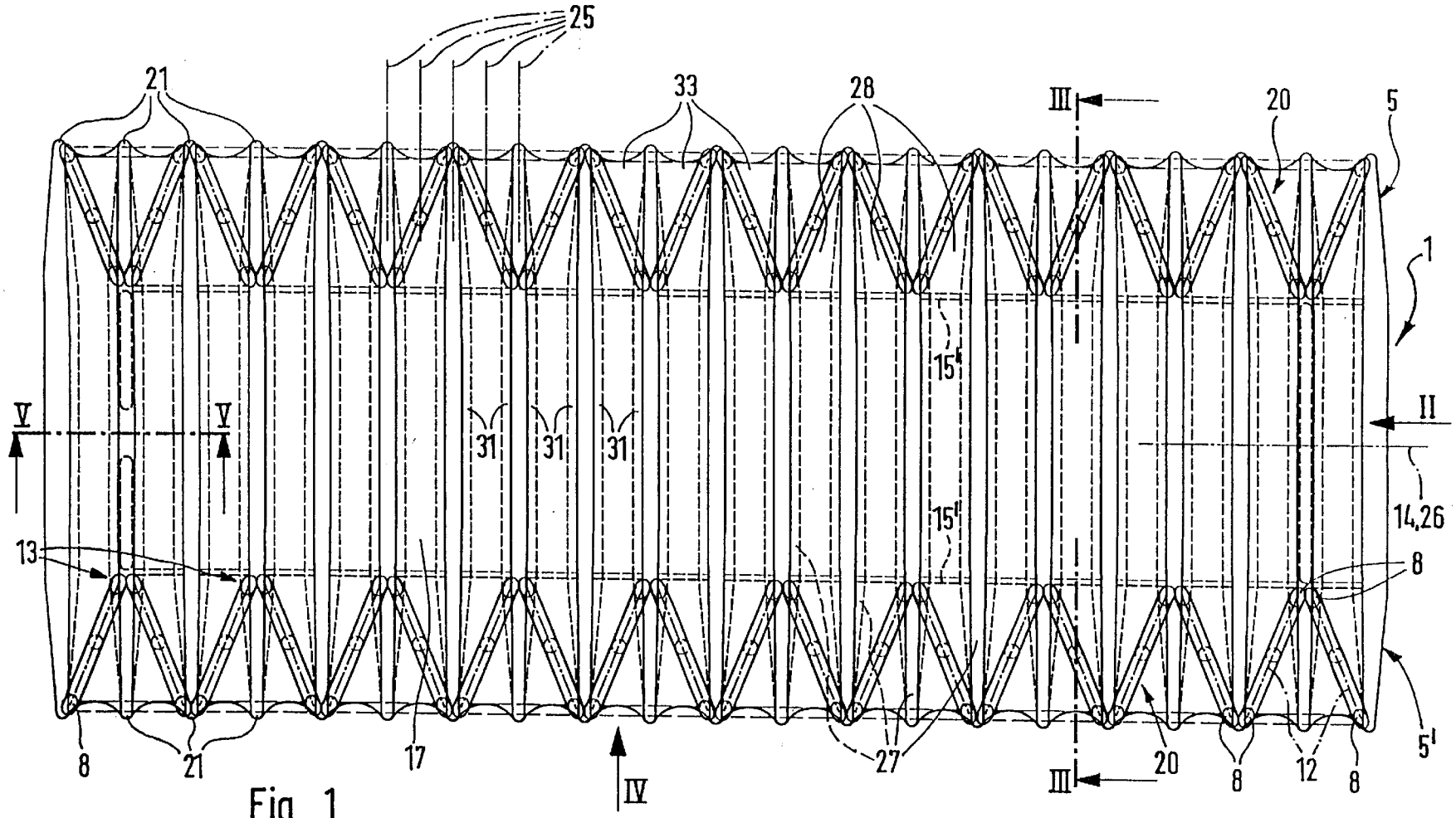
FIG. 1 shows a shed-like arrangement as a built structure with a roof of the invention in a preferred configuration looking in the direction of the arrow I in FIG. 2

The built structure possesses a bearer structure 3 which is supported on and secured to the ground 2 and which possesses a plurality of supports 4, which are arranged in two mutually parallel longitudinal rows 5 and 5' in sequence.

The supports 4 are in principle of any suitable type, but however it is a question preferably of supports of the type described in the said German utility model G 9,418,076.8, which are designed as hollow bodies filled with compressed air. In the present example each support 4 comprises a support column 6 extending up from the ground with two cantilever arms 7 extending in a forked manner at the top end. The supports 4 are so arranged that as seen in plan view, imaginary lines 12, connecting the support sections 8 of the cantilever arms 7 arranged at the free end of a respective support 4, form a zig-zag or triangular configuration within any given longitudinal row 5 and 5'. Apart from the two terminally arranged support sections 8 any two respective sections 8 of sequentially placed supports 4 are consequently arrayed together as support areas 13.

The built structure 1 has a longitudinal extent as indicated by a longitudinal axis 14 and a substantially rectangular plan. The four sides are shut off by walls 15, the side walls 15' extending in the longitudinal direction being arranged within the two longitudinal rows 5 and 5' of supports 4, which are accordingly separated off from the interior space 16 of the building.

The bearer structure 3 carries a roof 17 which is borne on the support sections 8 of the cantilever arms 7. The load to be borne of the roof 17 is hence taken up by the supports 4 and transferred to the ground 2. The roof 17 covers both the interior space 16 of the building and also the bearer structure 3.

Figure 5:
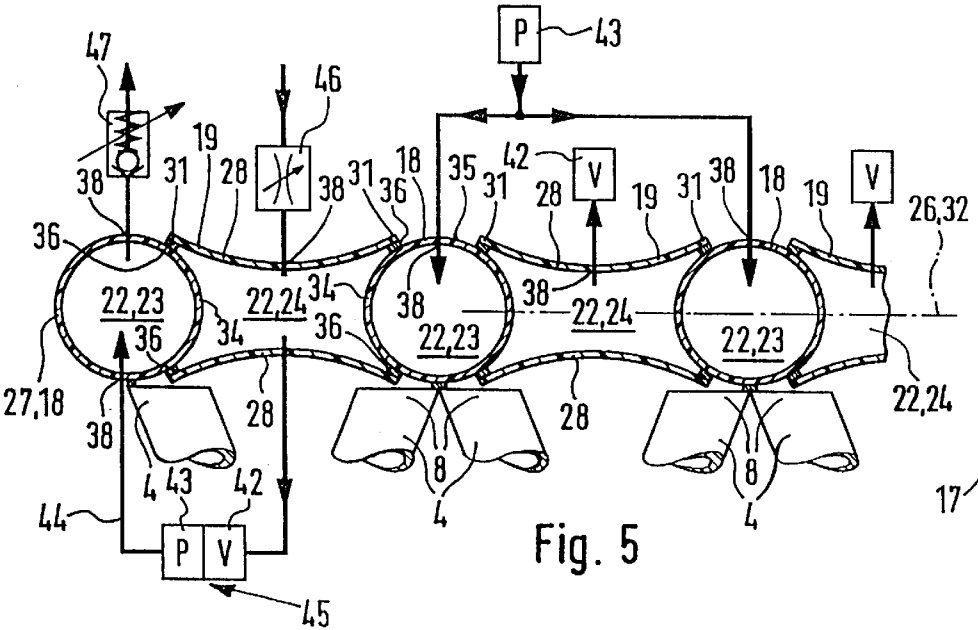
FIG. 5 is a longitudinal section through the roof of FIG. 1 taken on the section line V—V in a partial representation on a larger scale and in a highly diagrammatic form.

The roof 17 is designed in the form of a hollow body structure, whose design will be seen in detail from FIG. 5 in particular. It comprises interconnected walls 18 and 19 of flexible and preferably air-impermeable material, which are so shaped and arranged that they define and, respectively, form a plurality of elongated chambers 22. The chambers 22 are so aligned that their longitudinal axes 25 run athwart and more especially rectangularly to the said longitudinal axis 14, same being arranged in sequence with their sides adjacent so that they constitute a row of chambers 22, whose row direction 26 coincides with the longitudinal axis 14.

The said walls 18 and 19 are directly connected together so that the roof 17 represents a uniform, coherent sheet structure. At its marginal portions 20 on the sides it is carried by the supports 4, no further support means being required, owing to a mechanical design yet to be explained, in the interior space 16 of the building, i. e. within the area delimited by the supports 4.

It is therefore a question of a free span or self-supporting roof.

The strength of the roof 17 results to a substantial extent from the fact that the chambers 22 are partially designed as gage pressure chambers 23 and partially in the form of vacuum chambers 24, which are arranged in alternating succession in the row direction 26. Following a gage pressure chamber 23 arranged on either side of the built structure there is then a respective vacuum chamber 24, and then further pairs of gage pressure chambers and vacuum chambers 23 and 24 in an unchanging order.

As a material for the walls 18 and 19 a flexible plastic material is for example provided, which has a sufficient burst strength. For instance fiber-reinforced plastic material such as aramide-reinforced nylon could be employed. Furthermore it may be a question of a material in the form of a plastic fabric, which is preferably provided with a gas-tight coating on at least one side and preferably on both sides. It would be feasible as well to utilize a so-called twin-wall plastic fabric, in which two plastic fabric walls are connected together by threads so that there is an intermediate space. The above mentioned materials render possible the production of hollow bodies which are substantially true to form, both in the case of subjection to gage pressure and to vacuum. Nevertheless same may be readily shipped and handled in a pressure-less condition owing to their flexibility.

In the case of the embodiment of the invention there is a provision such that the gage pressure chambers are subject to a gage pressure, as related to the pressure of the atmosphere, of approximately 0.5 bar, a range of gage pressures of between 0.2 and 0.5 bar being regarded as appropriate. The walls 18 of the gage pressure chambers 23 are so configured that same constitute hose-like hollow bodies 27, which are turgidly inflated so as to function as roof beams with great flexural rigidity. Each of the hose-like hollow bodies 27 has its two terminal portions resting on a support section 8 or, respectively, on a support portion 13 where it is preferably secured in position by means of suitable joining means. Owing to the above mentioned zig-zag arrangement the sequentially placed hose-like hollow bodies 27 are alternatingly placed so that their terminal parts are supported relatively far to the outside and relatively farther to the inside.

In the vacuum chambers 24 there is a degree of vacuum which is only slightly below atmospheric pressure. In the embodiment of the invention it is of the order of 0.005 bar. This vacuum is sufficient to render stiff and turgid the walls 19 of the vacuum chambers 24 and to ensure a shape of the walls which is independent of the effects of wind and weather. The only slight degree of vacuum then contributes to hold apart the walls 18 of respectively adjacent gage pressure chambers 23, i. e. the respectively adjacent hose-like hollow bodies 27. The suction effect is not so great as to pull together the hollow bodies 27 supported on the supports 4 under their own weight.

If owing to the selected pressure condition and/or selection of material for the walls 18 and 19 there should be a tendency for the hose-like hollow bodies 27 to come together, such tendency may be simply counteracted if the walls 18 of at least two gage pressure chambers 23 are externally supported, as for example on the supports 4 of the bearer structure 3 of the roof 17. In the illustrated working embodiment of the invention of FIGS. 1 through 5 at least the two terminally, externally arranged hose-like hollow bodies 27 are fixed permanently in place, something performed by suitable attachment means on the supports 4. It is convenient however for all supports to ensure fixation in position.

Figure 2:
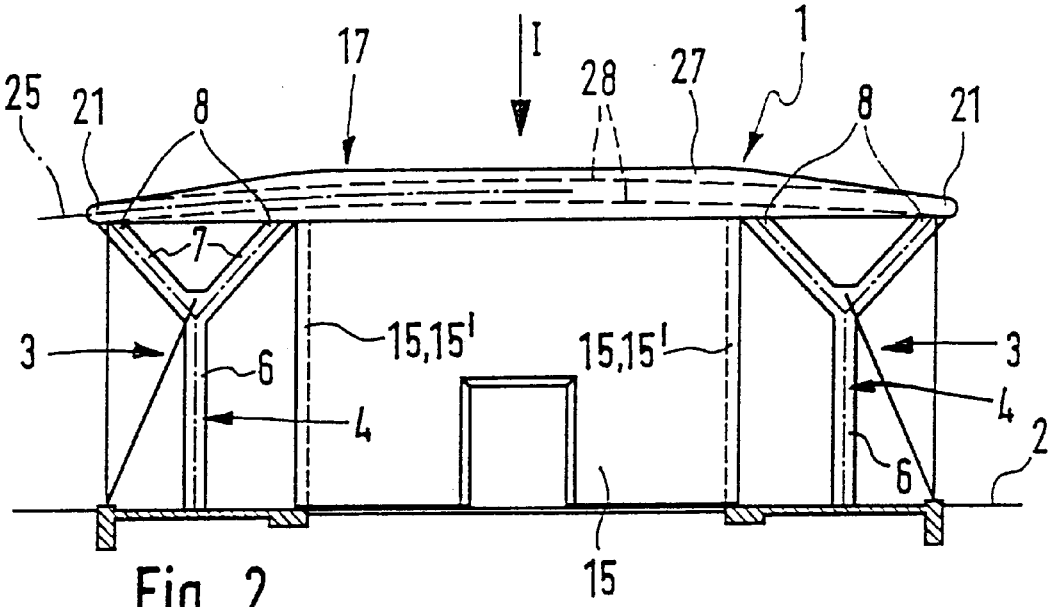
FIG. 2 is a front view of the building-like structure of FIG. 1 looking in the direction of the arrow II of FIG. 1.
Figure 3:
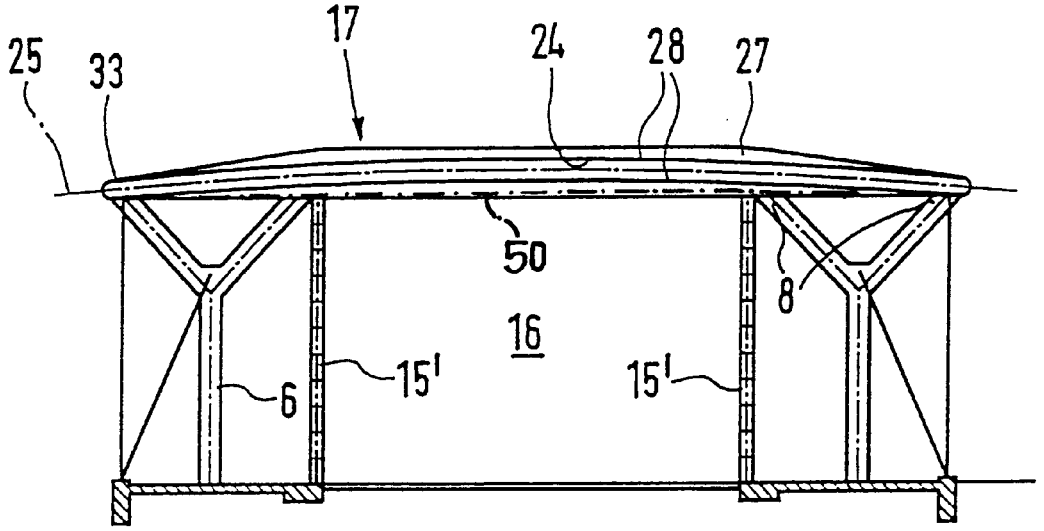
FIG. 3 shows the building-like structure of FIG. 1 in a cross section taken on the line III—III of FIG. 1.

As shown in FIG. 5 the hose-like hollow bodies 27 preferably possess a round cross sectional shape, which is more particularly circular. For reasons of mechanical strength there is preferably a provision such that the hose cross section has a minimum size at the two opposite terminal free portions 21 of the hose-like hollow bodies 27 and flares outward toward the center (center as considered in the longitudinal direction) so that the hose configuration which is thicker in the middle part and tapers toward the ends results as shown in FIGS. 2 and 3.

Figure 4:
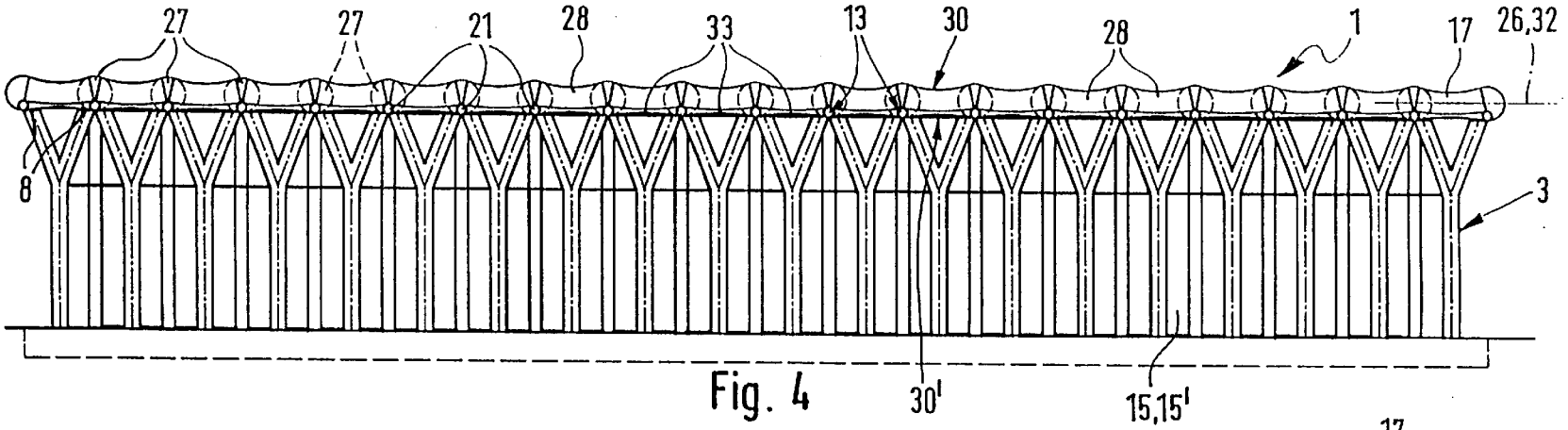
FIG. 4 is a side elevation of the building-like structure of FIG. 1 looking in the direction of the arrow IV.

For the formation of the vacuum chambers 24 arranged between respectively following hose-like hollow bodies 27 in principle any hose-like hollow bodies of suitable shape may be employed. However preferably, as illustrated, two diaphragm elements 28 having a flat form are provided. Same extend athwart the planes 32 defined by the row direction 26 and the longitudinal axes 25 of the roof 17 with a clearance between them and have their two marginal portions 31, on the sides thereof, fixed to the wall 18 of the associated hose-like hollow body 27. At their terminal portions 33 associated with the terminal portions 21 of the hose-like hollow bodies 27 same are permanently and preferably integrally joined to one another so that the two diaphragm elements 28 are practically constituted by the top and bottom length section of a tape-body in the form of unbroken loops. The terminal portions 33 are preferably rounded off and may in this respect, as shown in FIG. 4, be made concave over their width.

Furthermore the cross section of the vacuum chambers 24 may decrease toward the terminal sides 33, a feature which however is not adopted in the embodiment.

Owing to the subjection to vacuum of the vacuum chambers 23 the diaphragm elements 28 assume the concave, inwardly vaulted configuration as shown in FIG. 5 toward one another. Their width as measured in the row direction 26 is so selected that despite being subjected to vacuum they do not contact or bear against each other so that they are subject an inwardly negative bias directed inward toward the vacuum chamber 24, this leading to a turgid condition.

In the case of the preferred embodiment the mutually facing sections 34 of the wall 19 of the vacuum chambers 23 simultaneously constitute the lateral sections of the wall 19 of the intermediately placed vacuum chamber 24. Owing to this a substantial saving in material becomes possible.

In the condition ready for use of the roof the external and internal roof surfaces 30 and 30' depicted directed upward and downward in FIGS. 4 and 5 respectively possess a corrugated outline. One might well speak of a sort of pneumatic corrugated sheeting. The valleys are caused by the diaphragm elements 28 subject to vacuum, whereas the hills are due to the upwardly and downwardly directed wall sections 35 of the hollow bodies 27 subject to vacuum.

In principle it would be possible to connect the diaphragm elements 28 and the hose-like hollow bodies 27 permanently together, for instance by bonding, welding or by having an integral design.

The roof 17 of the embodiment has a modular design. It may be made up by detachably connecting together individual elements to form an overall structure of any desired length. For this purpose the hose-like hollow bodies 27 and the diaphragm elements 28 are designed in the form of parts which are separate from one another, which are detachably joined together by connection means 36, which are only indicated diagrammatically in the drawing.

The connection means 36, given by way of example, extend along the entire longitudinal edge of the diaphragm elements 28. In the illustrated working embodiment of the invention same are in the form of zip fasteners, whose one half is arranged on the hose-like hollow bodies 27 and whose other half is arranged on the respective diaphragm element 28. Alternative designs of possible connection means 36 may for example be so-called burr fastener means, adhesive joint means or hook or, respectively, detent joints. They are in any case so designed that accidental detachment due to the forces acting on them is not possible.

Figure 6:
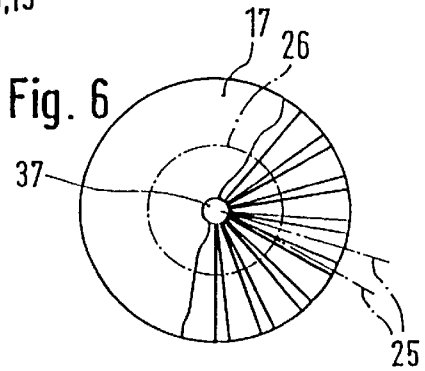
FIGS. 6 through 8 show embodiments of the invention for further roof configurations which may be erected.
Figure 7:
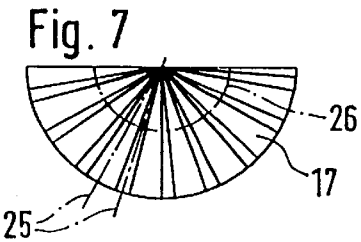
Figure 8:
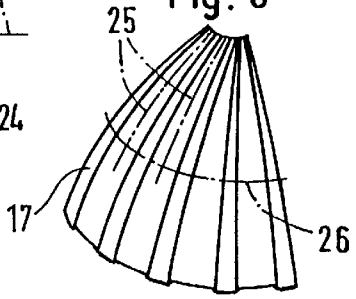

The modular design of the individual elements makes it particularly simple to erect different roof forms. While the embodiment of FIGS. 1 through 5 involves a linear extent in the row direction 26, it is readily possible to produce non-linear forms in the row direction, it being possible for the row direction 26 to have, at least in part, an arcuate form. FIGS. 6 through 8 show examples of possible modifications, in the case of which the row direction 26 describes a circular arc. It is in this manner that it is for example possible to design a roof with a circular outline (FIG. 6) or a semicircular roof outline (FIG. 7). The longitudinal axes 25 of the individual hollow chambers 22 in this case extend substantially radially in relation to a center 37.

By varying the longitudinal form 25 it is furthermore possible to ensure that the plane 32 of the roof 17 is vaulted. As shown in FIG. 3 the form of the hollow chambers 22 can be so selected that the roof 17, at least as regards its external roof surface 30, is upwardly vaulted across its span. The longitudinal axes 25 therefore rise in a direction away from the terminal portions 21 and 33 toward the longitudinal middle of a respective hollow chamber 22. Besides there being an improvement in the mechanical properties this has the effect as well that no rainwater will collect in the groove-like portions caused by the inward vaulting of the diaphragm elements 28. Such rainwater will flow off the external faces descending toward the terminal portions 33.

Figure 9:
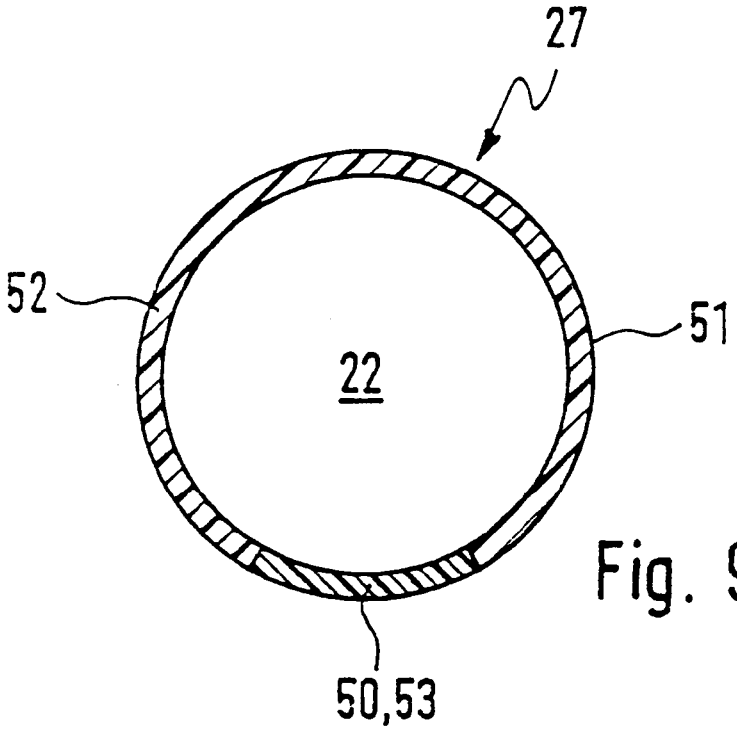
FIGS. 9 and 10 show advantageous configurations of the hose-like hollow bodies in a cross section generally similar to the section line V—V of FIG. 1.
Figure 10:
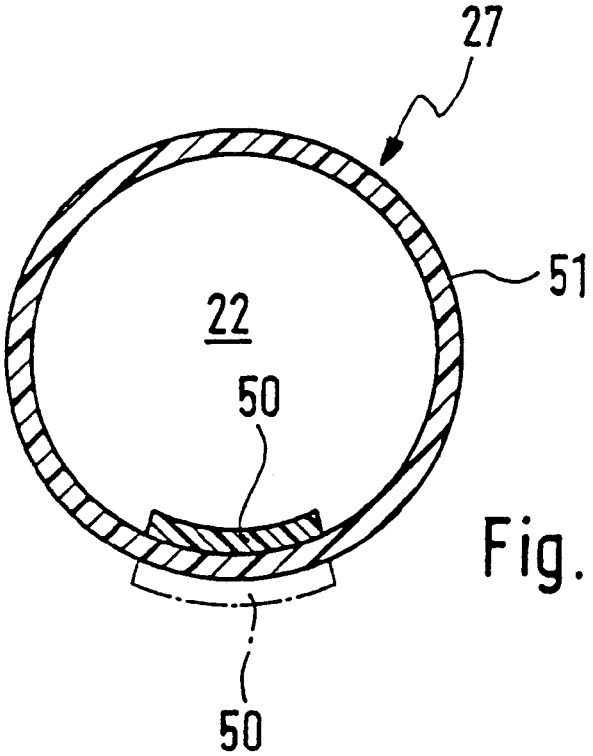

In order to produce a slight outward, vaulted form of the hose-like hollow bodies 27 with the simplest means, it is convenient to provide a strip 50 of material extending in the longitudinal direction of the hollow bodies in the portion of the hose-like hollow bodies 27 facing the inner roof face 30', such strip having a degree of stretch which is less than that of the remaining wall material of the hollow body 27. The strip 50 of material, which preferably extends along the full length of a respective hollow body 27 without interruption, is indicated in FIG. 3 in chained lines. FIGS. 9 and 10, which respectively show a cross section taken through one of the hose-like hollow bodies 27, will serve to indicate two advantageous possibilities for the application of the strip 50 of material.

In the illustrated working embodiment of the invention of FIG. 9 the strip 50 of material is a component of the hollow body wall 51. The hollow body 51 is composed of two wall sections 52 and 53 placed together in the peripheral direction, the one wall section 53 being constituted by the tape-like strip 50 of material, which is inelastic or is less elastic and the other wall section 52 consists of material with a higher degree of stretch. The strip 50 of material is in this case practically set in the wall 51 of the hollow body.

In the case of FIG. 10 there is hollow body wall 51, which is uninterrupted in the peripheral direction, and the strip 50 of material is permanently joined to the inner face of the hollow body wall 51 at the desired position on the periphery. Attachment is preferably performed by bonding in order not to affect the impermeability to air of the hollow body wall 51. The strip 50 of material might alternatively also be provided on the external face of the hollow body wall 51, something which is indicated in chained lines in FIG. 10.

It would also be possible to apply a strip 50 of material permanently, extending like a tape along the length of the hollow body, on the internal face and also on the external face of the hollow body.

The strip 50 of material is characterized in that as compared with the remaining wall material of the hollow body 27—in the case of FIG. 9, that is to say in comparison with the wall section 52 and in FIG. 10 in comparison with the hollow body wall 51 as such—it possesses a smaller degree of stretch or respectively a lower stretch factor or is completely unstretchable. In the present example it may consist of a high strength fiber material, such as aramide fiber material, whereas the remaining wall material is polyester material.

If the hollow body 27 is inflated, that is to say its chamber 22 subjected to gage pressure, the hollow body will stretch to a greater extent in the portions possessing a greater capacity to stretch elastically than in the portion in which the strip 50 of material is applied. Accordingly the result will generally be a hollow body 27 which is slightly vaulted or curved along its length, it being possible to speak of a banana-like vaulted shape.

Because the longitudinal form or extent 25 is forced to adopt an arcuate shape, it is readily possible to also produce complicated roof configurations, as for example the conchoidal shape indicated in FIG. 8.

It is particularly the non-linear configurations of the row direction 26 which may be produced in a particularly simple manner if the cut out form or pattern of the diaphragm elements 28 and accordingly the form of their longitudinal edges 31 is modified. Thus the design of the roofs in accordance with FIGS. 6 and 7 differs from the design of the roof of FIGS. 1 through 5 substantially merely in that the diaphragm elements 28 employed have a different cut out pattern, same being relatively wide at the outer terminal portions 33 and tapering toward the opposite terminal face, which is arranged in the middle 37 of the roof.

It is convenient for at least one opening 38 to be directed into each chamber 22 so that via such opening gas may be supplied to the gage pressure chambers 23 and as required the vacuum chambers 24 may be evacuated. All in all it is preferably a question of a pneumatic arrangement, in the case of which air is utilized as a pressure medium, although in principle a suitable gas, as for example helium, might be employed.

Each opening 38 may be provided with a sealing closure, which renders possible a gas-tight closing action, after the pressure levels have been set as required. It is more particularly the vacuum however which owing to leaks, which can not be prevented in practice, can hardly be maintained without adopting additional measures. For this reason it is an advantage if all vacuum chambers 24 are connected with suction devices 42, as for example pumps, which constantly serve to provide for a maintenance of the necessary degree of vacuum. In this respect it is possible to provide each vacuum chamber with its own suction device 42. For reasons of costs it is however a better recommendation to connect individual groups of vacuum chambers or even all of the vacuum chambers with a common suction device. The same will apply for the gage pressure chambers 23 as regards the pressure producing means 43.

With the aid of constantly connected suction devices 42 and pressure producing means 43 it is possible to set desired pressure levels, which are monitored and maintained all the time using a regulating system. If required it is possible in this respect to connect the chambers 22 with valves in addition, which aid in producing the regulating action.

A particularly advantageous design for providing the necessary levels of pressure is indicated in FIG. 5. Here one vacuum chamber 24 is connected with a gage pressure via a line 44 to a vacuum chamber 23, a pump 45, constituted for example by a compressor or a blower, being arranged on the line 44 between the ends thereof, such pump functioning as a suction device 42 with respect to the vacuum chamber 24 and as a pressure producing device 43 with respect to the gage pressure chamber 23. The air is consequently drawn off from the vacuum chamber and supplied to the gage pressure chamber.

In this respect it may be an advantage to adopt measures that provide for a continuous air current. Such measures may in accordance with the embodiment of the invention include inter alia a provision such that the vacuum chamber 24 is in communication with the surroundings via an inlet valve 46, connected with an opening 38 and similarly the gage pressure chamber 23 is connected via an outlet valve 47. The inlet valve 46 is conveniently in the form of a choke valve with an adjustable choke factor. The outlet valve 47 is preferably an excess pressure valve with an adjustable closing force. By means of the settings of the valves 46 and 47 it is possible for instance to change the volumetric flow and accordingly the pressure in the chambers 22.

The above description will make it clear that at the connection means 36 between the diaphragm elements 28 and the hose-like hollow bodies 27 it is not necessary for complete gas-tightness to be ensured. It is even possible to intentionally tolerate a certain degree of air permeability or leakage in the connection means 36 in order to ensure the above mentioned air circulation or air current, it in some cases being possible to dispense with an additional inlet valve 46. The same applies for a case in which the material employed for the walls 18 and 19 of the chambers 22 is slightly permeable to air.

If a configuration is selected in which in the described manner a flow connection 44 is present between a vacuum chamber 24 and a gage pressure chamber 23, there is the possibility of simultaneously connecting several vacuum chambers 24 with the inlet of the pump 45 and simultaneously several gage pressure chambers 23 with the outlet of the pump 45. In this case it is convenient to utilize a radial blower producing a high volumetric flow rate as a pump 45.

The roof of the invention is not only strong and self-supporting but furthermore is able to resist loads due to the weather and to transmit the same to the ground without damage.

We claim:

1. A modular roof of a built structure comprising:

a hollow body structure with linked walls (18 and 19) of flexible and at least substantially air-impermeable material, the walls (18 and 19) delimiting, in a row direction, elongated chambers (22) arranged in sequence side by side, such chambers being in the form of alternating gage pressure chambers (23) subject to a gage pressure and vacuum chambers (24) subject to vacuum, the gage pressure chambers being formed of hose-like hollow bodies (27), and the vacuum chambers being defined by two spaced diaphragm elements (28) extending between adjacently disposed hollow bodies; and a connection device (36) for detachably securing longitudinal edges of the diaphragm elements (28) to the hollow bodies, such that the diaphragm elements and hollow bodies are separate components that may be selectively assembled to form the roof.

2. The roof as claimed in claim 1, characterized in that the hose-like hollow bodies (27) possess a round cross sectional shape.

3. The roof as claimed in claim 1, characterized in that at least at an external roof face (30) the hose-like hollow bodies (27) are outwardly vaulted, along the longitudinal direction thereof, toward the outer side of the roof and in that the hollow bodies each include mutually opposite terminal portions (21) and a cross section of each of the hollow bodies has a minimum size at the terminal portions which becomes larger toward a longitudinal middle portion so that in the middle portion there is an outwardly bulging hose form which tapers toward the opposed terminal portions (21).

4. The roof as claimed in claim 3, characterized in that in the portion facing an inner roof face (30') the wall of a respective hose-like hollow body (27) has a strip of material which extends in the longitudinal direction and has a degree of stretch less than that of the remaining wall material, such strip producing the outward vaulting of the hollow body (27) when the gage pressure chamber (23) is subject to pressure.

5. The roof as claimed in claim 1, characterized in that the connecting devices (36) are semi-permeable to air.

6. The roof as claimed in claim 1, characterized in that the walls (18) delimiting the gage pressure chambers (23) are curved convexly outward and the walls (19) delimiting the vacuum chambers (24) are curved concavely inward.

7. The roof as claimed in claim 1, characterized in that the gage pressure chambers (23) are connected with pressure producing means (43), which ensure a regulated maintenance of the gage pressure.

8. The roof as claimed in claim 7, characterized in that the gage pressure chambers (23) are connected with pressure producing means (43) and the vacuum chambers (24) are connected with suction means (42).

9. The roof as claimed in claim 7, characterized in that the vacuum chambers (24) are connected with the surroundings outside the vacuum chambers via a flow variable inlet valve (46).

10. The roof as claimed in claim 7, characterized in that the gage pressure chambers (23) are connected with the surroundings outside the vacuum chambers via an outlet valve (47) which is more particularly designed as an adjustable valve.

11. The roof as claimed in claim 1, characterized in that the vacuum chambers (24) are connected with suction means (42), which ensure a regulated maintenance of the vacuum.

12. The roof as claimed in claim 1 characterized in that at least one vacuum chamber (24) and at least one gage pressure chamber (23) are fluidly connected with one another via an intermediately placed combined suction and pressure producing means (42 and 43), which as regards the vacuum chamber functions as a suction means and as regards the gage pressure chamber functions as a pressure producing means.

13. The roof as claimed in claim 1, characterized in that the chambers (22) are vaulted outwardly toward the outer face of the roof in their longitudinal direction.

14. The roof as claimed in claim 1, characterized in that the cross section of the gage pressure chambers (23) and of the vacuum chambers (24) increases from the closed terminal portions (21 and 23) toward the middle thereof.

15. A roof structure comprising:

a hollow body structure with linked walls of flexible and at least substantially air-impermeable material, the walls delimiting, in a row direction, elongated chambers arranged in sequence side by side including alternating gage pressure chambers subject to a gage pressure and vacuum chambers subject to vacuum, the gage pressure chambers being formed of hose-like hollow bodies having opposed terminal ends, each of the hollow bodies having a substantially round cross sectional diameter, the cross sectional diameter increasing from the terminal ends toward a longitudinal middle of the hollow body, each of the hollow bodies being vaulted outwardly along a longitudinal extent thereof.

16. A roof structure comprising:

a hollow body structure with linked walls of flexible and at least substantially air-impermeable material, the walls delimiting, in a row direction, elongated chambers arranged in sequence side by side including alternating gage pressure chambers subject to a gage pressure and vacuum chambers subject to vacuum, wherein at least one vacuum chamber and at least one gage pressure chamber are fluidly connected with one another via an intermediately placed combined suction and pressure producing device having a suction port operatively connected to the at least one vacuum chamber and a pressure port operatively connected to the at least one gage pressure chamber.

17. A roof structure comprising:

a hollow body structure with linked walls of flexible and at least substantially air-impermeable material, the walls delimiting, in a row direction, elongated chambers arranged in sequence side by side including alternating gage pressure chambers subject to a gage pressure and vacuum chambers subject to vacuum, the gage pressure chambers being formed of hose-like hollow bodies, wherein the vacuum chambers (24) are connected with the surroundings outside the vacuum chambers via a flow variable inlet valve (46) and connected to a vacuum source via an outlet valve.

* * * * *